US005765689A

United States Patent [19]

Cobden et al.

[11] Patent Number: 5,765,689

[45] Date of Patent: Jun. 16, 1998

[54] DRINK TRAY

[76] Inventors: Peter John Cobden, 178 Holdsworth Rd., Bendigo, Australia, VIC3550; Henry Rijken, 138 Thomas La., Neilbourgh VIC, Australia

[21] Appl. No.: 796,371

[22] Filed: Feb. 6, 1997

[51] Int. Cl.[6] ..... B65D 85/00

[52] U.S. Cl. ..... 206/562; 220/4.23

[58] Field of Search ..... 206/427, 562, 206/564, 217; 220/4.21, 4.22, 4.23

[56] References Cited

U.S. PATENT DOCUMENTS

| | | | |
|---|---|---|---|
| 2,026,396 | 12/1935 | Meineck | 206/562 |
| 3,376,974 | 4/1968 | Hilliard | 206/562 |
| 3,994,465 | 11/1976 | Rudnitzky | 248/311 |
| 5,141,194 | 8/1992 | Burgess et al. | 248/311 |
| 5,549,204 | 8/1996 | Toren | 220/4.23 |

*Primary Examiner*—Jacob K. Ackun

*Attorney, Agent, or Firm*—Finnegan, Henderson, Farabow, Garrett & Dunner

[57] ABSTRACT

A portable foldable drink tray having at least two portions hinged to each other, the hinge being such to allow folding in one direction, but is prevented by stops to fold in the other direction. Holes are provided in each portion to receive drink containers. When not in use the tray may be folded for carrying in a pocket or personal purse or bag.

6 Claims, 2 Drawing Sheets

DRINK TRAY

This invention relates to a drink tray, more particularly to a drink tray which is portable and which can be used at sporting and entertainment functions.

BACKGROUND OF THE INVENTION

At many public functions, such as sporting events, refreshments are available at canteens and other outlets serving drinks. At these functions often a patron purchases drinks for a number of people and then has to carry a number of drinks away from the outlet. Such drinks which may be cool or chilled are usually served in cans, bottles, disposable glasses or cups, or hot drinks such as coffee may be served in insulated glasses eg. disposable polystyrene cups or glasses. If the drinks are served in bottles or glasses it is possible, often with difficulty to carry three or four at the one time. However if the drinks are served in disposable glasses or cups, these are relatively flexible and thus it is often not possible to carry more than two, one in each hand.

It is known that trays are often available with which to carry a number of glasses or tumblers. These are of cardboard and folded to form the tray. However these trays are designed to be used at a single function only, and while they may be reused, they are not robust and cannot usually withstand spillage of liquid thereon.

U.S. Pat. No. 5,141,194 describes a folding beverage holder for motor vehicles, which has cup apertures formed in a folding plate. The plate when unfolded is supported by a pair of legs, the whole assembly being folded and inserted into a slot for storage.

Also U.S. Pat. No. 3,994,465 describes a folding tray having support members which slide over the pivots of the tray to lock the tray in the open position It is an object of this invention to provide a re-useable drink tray for use at public performances and sporting events.

It is a further object of the invention to provide a drink tray which is foldable so that it can be easily carried in a pocket or handbag or the like.

A still further object of the invention is to provide a drink tray which is foldable but when in use it is stable to hold the drinks thereon.

It is also an object of the invention to provide a foldable drink tray which can be clipped or latched in the folded position.

It is a still further object of the invention to provide a drink tray which is adapted to carry more than one type of drink container.

BRIEF STATEMENT OF THE INVENTION

Thus there is provided according to the invention a portable foldable drink tray adapted to carry one or more different drink containers, said tray comprising at least two portions hinged together to be folded into a convenient package when not in use, each portion comprising at least one aperture, each aperture having an internal periphery and when unfolded into a useable condition, adapted to receive a drink container into the said aperture and be retained therein whereby the tray with the drink container can be carried to the point of consumption of the drink.

It is preferred that the internal periphery of each aperture comprises a flexible lip which will deflect to allow the insertion of the container into the aperture, and will retain the container in the aperture while the tray is carried from the service area to the area of consumption.

It is to be noted that the term "drink container" is intended to include containers, cans, small bottles containing such drinks such as beer and other drinks in a bottle of a size commonly referred to as "stubbies", and glasses whether of glass or plastic construction. Thus the term is to include any article or container in which a drink is served at an entertainment centre including those cardboard or plasticised paper or card containers in which milk shakes are served, as well as insulated polystyrene tumblers.

BRIEF DESCRIPTION OF THE DRAWINGS

In order to more fully describe the invention reference will now be made to the accompanying drawings in which.

DESCRIPTION OF THE PREFERRED EMBODIMENT

One embodiment of the invention will now be described with reference to the accompanying drawings.

Figure 1:
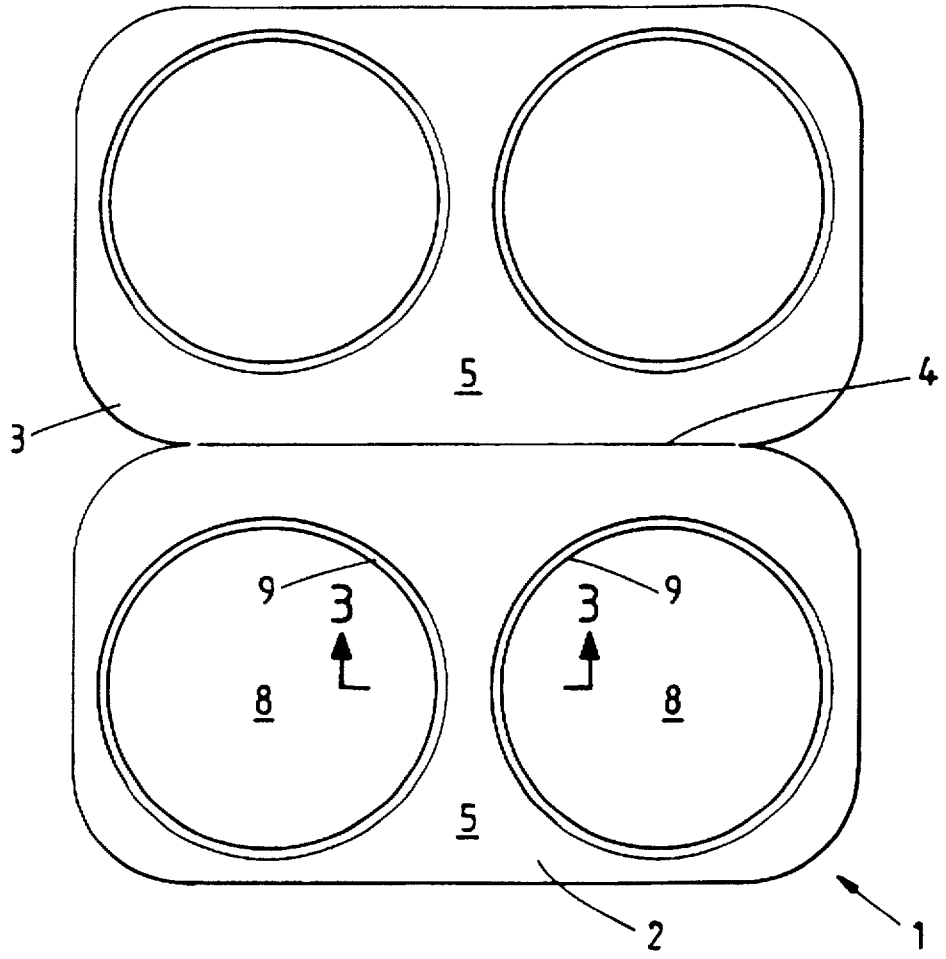
FIG. 1 shows a top view of one form of the tray according to the invention.
Figure 2:
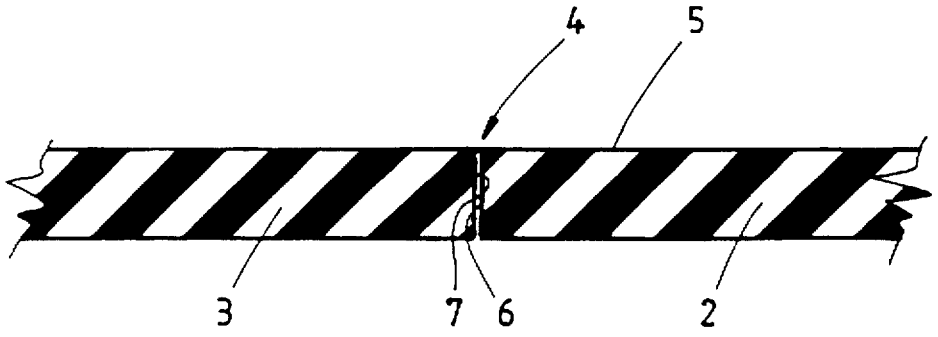
FIG. 2 shows an enlargement of the hinge.
Figure 3:
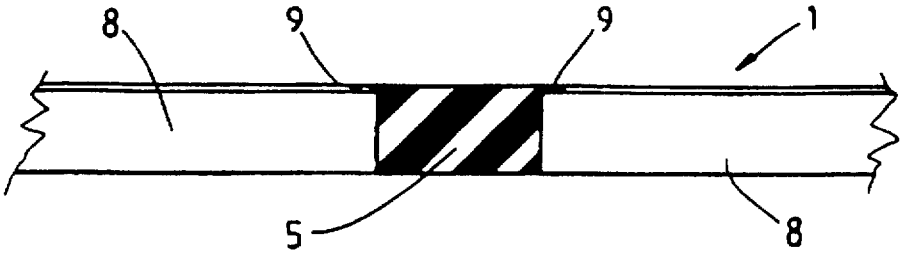
FIG. 3 is a cross-sectional view on lines 3—3 of FIG. 1.
Figure 4:
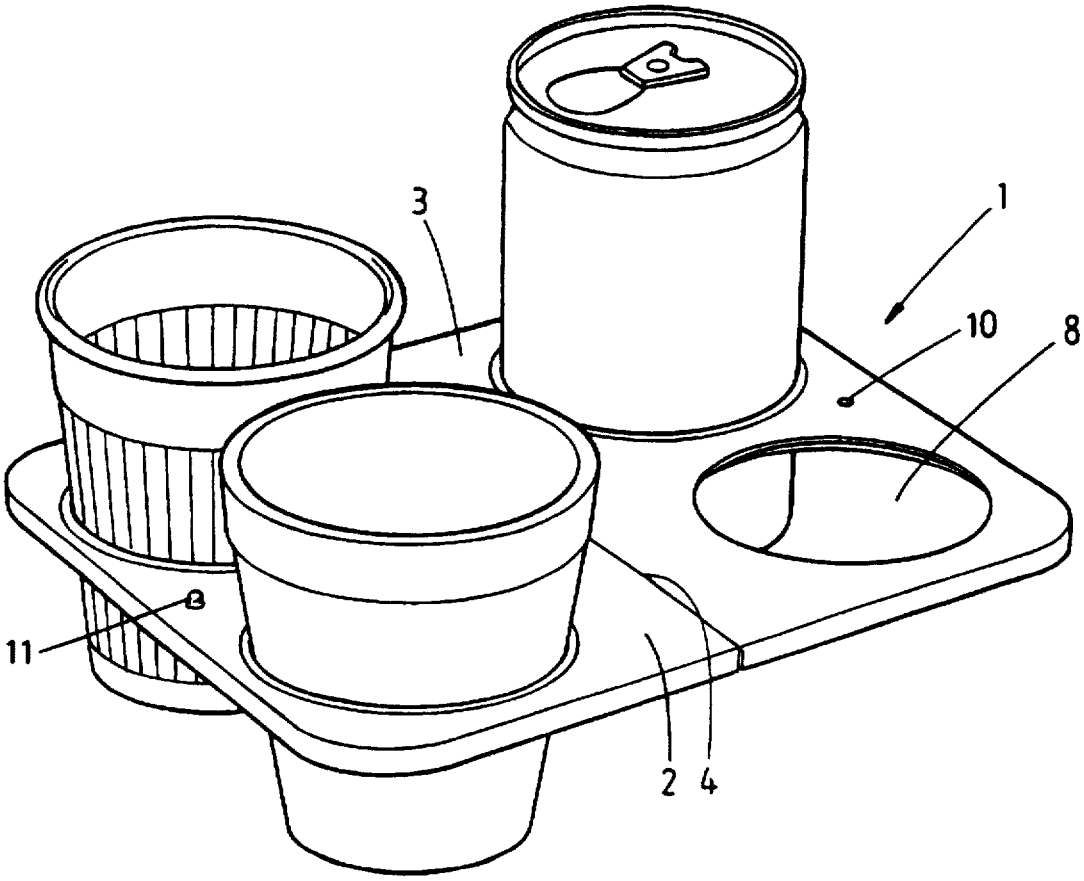
FIG. 4 shows an example of the tray in use carrying a variety of drinks containers.

In this embodiment the tray 1 can comprise two portions 2 and 3, each of which can be formed of a suitable plastic material such as polypropylene joined by a flexible plastic hinge 4. The portions 2 and 3 are preferably moulded as an integral unit with the connecting hinge 4 formed by a continuation of the upper surface 5 of the two portions 2 and 3 so that the two portions can be unfolded into a flat open position for use as shown on FIG. 1 or folded up towards each other into a closed position. Thus in this folded condition the tray can be easily carried personally either in a pocket, handbag or other bag of the user. By the top surface 5 joining the two portions 2 and 3, when the tray is unfolded into the position shown in the drawings, the adjacent end portions 6 and 7 abut each other to prevent the tray over folding or over hinging past the 180 degree position of the portions. Thus the tray may be in the folded position with the portions 2 and 3 abutting each other, or spread into the carrying position with the portions planar to each other as shown in the drawings, the end portions of each portion preventing the portions passing over the 180 degree position.

As shown in the enlarged view of the hinge, the hinge is formed by a notch or slot or the like extending from the undersurface of the tray toward but not extending to the upper surface of the tray. Thus the thinner portion forms the hinge, while the two sides of the notch or slot when the tray is unfolded will abut each other to maintain the tray in the open position.

Each of the holes 8 in each portion 2 and 3 of the tray is preferably formed with a diameter to hold the majority of drink containers available at such locations. Thus in one example the tray portions can be formed of a plastic material 3 mm in thickness, having a hole diameter of 70 mm. In order to secure and retain a drink container in the hole, the hole has a lip 9 of 2 mm width extending around the internal diameter of the hole, this lip thus having a 67 mm internal diameter. While the tray portions have a thickness of 3 mm, the lip portions have a thickness of 0.5 mm.

This flexible lip allows the insertion of a drink container into the aperture, the flexible lip providing sufficient frictional grip on the drink container to retain it in position during carrying to the point of use where the container can be easily removed for the consumption of its contents.

Thus the apertures are dimensioned to receive the drink containers in most common use. Thus many drinks are packaged in aluminium cans, and the aperture and flexible lip are dimensioned so that the more rigid portion at the end of the can can be pushed through the aperture, the lip then gripping on the wall of the can to retain the can in position. By grasping the can, the can will easily be withdrawn from the aperture. Also drinks are dispensed in disposable tumblers, and the same size aperture can hold various sized tumblers. Thus one type of tumbler may be supported by its upper rim, another will be supported by the wall of the tumbler. Also insulated polystyrene tumblers in which hot drinks are dispensed will also be able to be carried by the tray, the bottom of the tumbler passing through the aperture and the lip supporting the tumbler some distance from the bottom of the tumbler.

The tray when folded is preferably of a size which can fit into a pocket, handbag or other carrying bag. Thus the tray can be retained by the user for reuse, and when not in use can easily be carried in a pocket or the like. Also the tray can be used in domestic situations and used for serving drinks to guests at functions such as barbecues.

When not in use the tray can be folded and the two portions secured to each other by securing means. One form of securing means for securing the two portions together is shown where one portion has a small recess and the 10 other portion has a small nipple 11 which is adapted to be clipped into the recess. It is to be realised that other forms of securing the two portions together can be provided, such as a small tag on one portion which can be passed over the end of the other portion and then attached by a clip or snap action attachment to the other portion.

While the tray above has been described as being constructed of a suitable plastics material, it is to be realised that the tray can be constructed from other materials, such as cardboard with the holes for the containers provided with a flexible lip to hold and retain the drink containers. Preferably the cardboard is treated or coated with a suitable plastics material to provide durability and to protect the cardboard in the event of spillage of the liquid in the containers.

It will be realised that while one form of hinge has been described above, other forms of hinge may be used, as long as the hinge will prevent the two portions of the tray from opening past 180°. In an alternative construction the hinge may be a thinning of the plastic material, and on the undersurface of each portion of the tray, abutments or stops may be provided adjacent the hinge line, so that when the tray is opened out, the stops on each side will engage to prevent further opening of the tray portions.

Also while the flexible lip and tray have been described above with specific dimensions, it is to be realised that these can vary depending on tray size and the ability of the lip to hold the drink containers. Thus the lip or edge of the apertures may be coated with or provided with a material which grips the container, such as a foam plastics material, or a semi tacky material.

While the above example shows a tray to carry four drink containers only, it is to be realised that the invention can be extended to carry 6 containers by adding another portion hinged to portion 3. In this instance the hinges will be modified so that the portions fold one on the other, the respective hinges being so modified with stops or other abutments so that the tray will be stable in the unfolded position.

Also the tray may have a hole or holes for drink containers and in addition holes for food containers. These may be square or oval depending upon the type of food container. Thus one or more holes can be square to receive a container or box of potato chips.

Also the tray may have foldable handles so that it is easy to carry.

Although one embodiment of the invention has been described in some detail it is to be realised that the invention is not to be limited thereto but to include variations and modifications falling within the spirit and scope of the invention.

We claim:

1. A portable foldable drink tray adapted to carry one or more different drink containers, said tray comprising at least two portions hinged together so that said portions can be folded into a closed position when not in use, and unfolded into a flat open position for use, means for limiting the position of the portions in the open position so that an upper surface of each portion is planar to each other, each portion having at least one aperture, each aperture having an internal periphery and when unfolded into said open position, adapted to receive a drink container into the aperture and be retained therein whereby the tray with the drink container can be carried in the open position to the point of consumption of the drink container.

2. The protable foldable drink tray of claim 1, including means for securing the two portions together when folded into said closed position whereby the tray may be carried in a pocket or personal bag.

3. The portable foldable drink tray of claim 2, wherein the securing means comprises a protrusion on one portion that snaps into a recess on the other portion.

4. The portable foldable drink tray of claim 1, wherein each aperture has an internal lip dimensioned to grip on an outer surface of a container inserted therein.

5. The portable foldable drink tray of claim 1, wherein the tray is formed of a rigid plastics material and the two portions are hinged to each other by a hinge formed by a reduced portion of the plastics material joining the two portions together and said means for limiting the position of the portions in the open position comprises end abutments on each adjacent portion which abut against each other when the portions are unfolded into the flat open position.

6. The portabe foldable drink tray of claim 4, wherein the tray is formed of a rigid plastics material and each lip is formed by an extension of the plastics material from one surface of the respective portion, the lip being dimensioned to be sufficiently flexible to be deformed and retain a container in the aperture.

* * * * *